US010421924B2

(12) United States Patent
Hasegawa et al.

(10) Patent No.: US 10,421,924 B2
(45) Date of Patent: Sep. 24, 2019

(54) WATER-BASED COOLANT

(71) Applicant: IDEMITSU KOSAN CO., LTD., Chiyoda-ku (JP)

(72) Inventors: Mayu Hasegawa, Ichihara (JP); Masahisa Goto, Ichihara (JP); Katsumi Ichitani, Ichihara (JP); Kenro Noguchi, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/594,171

(22) Filed: May 12, 2017

(65) Prior Publication Data

US 2017/0247633 A1 Aug. 31, 2017

Related U.S. Application Data

(63) Continuation of application No. 14/651,410, filed as application No. PCT/JP2013/083055 on Dec. 10, 2013, now abandoned.

(30) Foreign Application Priority Data

Dec. 27, 2012 (JP) ..... 2012-286247

(51) Int. Cl.

| | |
|---|---|
| ***C10M 173/02*** | (2006.01) |
| ***C10M 141/08*** | (2006.01) |
| ***C21D 1/60*** | (2006.01) |
| ***C10M 103/00*** | (2006.01) |
| ***C10M 125/10*** | (2006.01) |
| ***C10M 125/24*** | (2006.01) |
| ***C10M 125/26*** | (2006.01) |
| ***C10M 133/42*** | (2006.01) |
| ***C10M 135/28*** | (2006.01) |
| ***C10M 135/36*** | (2006.01) |
| ***C21D 1/58*** | (2006.01) |

(52) U.S. Cl.

CPC ..... *C10M 173/02* (2013.01); *C10M 103/00* (2013.01); *C10M 125/10* (2013.01); *C10M 125/24* (2013.01); *C10M 125/26* (2013.01); *C10M 133/42* (2013.01); *C10M 135/28* (2013.01); *C10M 135/36* (2013.01); *C10M 141/08* (2013.01); *C21D 1/58* (2013.01); *C21D 1/60* (2013.01); *C10M 2201/043* (2013.01); *C10M 2201/062* (2013.01); *C10M 2201/081* (2013.01); *C10M 2201/082* (2013.01); *C10M 2201/085* (2013.01); *C10M 2201/087* (2013.01); *C10M 2207/122* (2013.01); *C10M 2215/222* (2013.01); *C10M 2215/223* (2013.01); *C10M 2215/224* (2013.01); *C10M 2219/09* (2013.01); *C10M 2219/104* (2013.01); *C10N 2210/01* (2013.01); *C10N 2210/02* (2013.01); *C10N 2210/06* (2013.01); *C10N 2230/10* (2013.01); *C10N 2230/12* (2013.01); *C10N 2230/16* (2013.01); *C10N 2240/401* (2013.01)

(58) Field of Classification Search

CPC ..... C10M 141/08; C10M 103/00; C10M 133/38; C10M 173/02; C10M 103/06; C21D 1/60

See application file for complete search history.

(56) References Cited

U.S. PATENT DOCUMENTS

| | | | | |
|---|---|---|---|---|
| 3,618,707 | A * | 11/1971 | Sluhan | B23Q 11/1069 184/109 |
| 4,208,344 | A | 6/1980 | Dingwall et al. | |
| 4,719,035 | A | 1/1988 | Palmer | |
| 5,766,505 | A | 6/1998 | Kanamori et al. | |
| 6,572,789 | B1 * | 6/2003 | Yang | C02F 5/14 252/387 |
| 2007/0241306 | A1 | 10/2007 | Wehner | |
| 2008/0035880 | A1 | 2/2008 | Egawa et al. | |
| 2015/0000710 | A1 | 1/2015 | Hasegawa et al. | |

FOREIGN PATENT DOCUMENTS

| | | | | |
|---|---|---|---|---|
| AU | 3721000 | A * | 9/2000 | C10M 159/12 |
| CN | 1196079 | A | 10/1998 | |
| CN | 1362502 | A | 8/2002 | |
| CN | 1995299 | A | 7/2007 | |
| CN | 102115807 | A | 7/2011 | |
| CN | 102703194 | A | 10/2012 | |
| CN | 102822324 | A | 12/2012 | |
| CN | 102834493 | A | 12/2012 | |
| JP | 59-229496 | | 12/1984 | |
| JP | 64-42521 | | 2/1989 | |
| JP | 1-259119 | | 10/1989 | |
| JP | 2-157088 | A | 6/1990 | |
| JP | 6-336607 | A | 12/1994 | |
| JP | 52-93635 | A | 8/1997 | |
| JP | 9-227932 | | 9/1997 | |
| JP | 11-50212 | A | 2/1999 | |
| JP | 2002-503260 | A | 1/2002 | |
| JP | 2002-66871 | A | 3/2002 | |
| JP | 2002-265973 | | 9/2002 | |
| JP | 2003-201580 | A | 7/2003 | |

(Continued)

OTHER PUBLICATIONS

Office Action dated Feb. 9, 2016 in Japanese Patent Application No. 2012-286247.

(Continued)

*Primary Examiner* — Taiwo Oladapo

(74) *Attorney, Agent, or Firm* — Oblon, McClelland, Maier & Neustadt, L.L.P.

(57) ABSTRACT

Disclosed herein is a method of using a water-based coolant for quenching or cutting a metal material. The water-based coolant is formed of: water; at least one inorganic acid salt selected from the group consisting of a carbonate, a hydrogen carbonate, a sesquicarbonate, a phosphate, a borate, a molybdate and a tungstate; a metal corrosion inhibitor; and optionally at least one of a bactericide, a water-soluble rust inhibitor, an antioxidant and a detergent dispersant.

11 Claims, No Drawings

(56) References Cited

FOREIGN PATENT DOCUMENTS

| | | | | |
|---|---|---|---|---|
| JP | 2004-175872 | A | 6/2004 | |
| JP | 2007-99905 | A | 4/2007 | |
| JP | 2008-189806 | A | 8/2008 | |
| JP | 2008-239917 | A | 10/2008 | |
| JP | 2010-270256 | A | 12/2010 | |
| JP | 2011-168860 | | 9/2011 | |
| WO | WO 97/04052 | A1 | 2/1997 | |
| WO | WO-2011044718 | A1 * | 4/2011 | ..... C10M 173/02 |
| WO | 2013/129467 | A1 | 9/2013 | |

OTHER PUBLICATIONS

Extended European Search Report dated Jul. 27, 2016 in Patent Application No. 13867576.4.
Combined Chinese Office Action and Search Report dated May 30, 2016 in Patent Application No. 201380068332.7.
Office Action dated Jan. 5, 2017 in Chinese Patent Application No. 201380068332.7.
International Search Report dated Jan. 21, 2014, in PCT/JP2013/083055 filed Dec. 10, 2013.
Owaku Shigeo, "Study on Quenching Cracks", Quenching Treatment, vol. 7, No. 3, Jun. 1967, pp. 140-144 (with English Translation).
Office Action dated Nov. 17, 2015 in Japanese Patent Application No. 2012-286247.
Information Offer Form submitted by a third party dated Jan. 29, 2016 for corresponding Japanese Patent Application No. 2012-286247.
Taiwanese Office Action dated Aug. 22, 2017 in Taiwanese Patent Application No. 102146935 (with English translation of Category of Cited Documents).
Taiwanese Office Action dated Aug. 22, 2017 in Taiwanese Patent Application No. 102146935 (with English translation).
Li Qiang, "Quenching Medium for Heat Treatment and Its New Development", Journal of Zhengzhou Textile Institute, vol. 12 No. 2, Jun. 2001, pp. 30-32.

* cited by examiner

WATER-BASED COOLANT

CROSS-REFERENCE TO RELATED APPLICATIONS

This application is a Continuation of U.S. application Ser. No. 14/651,410, which was filed on Jun. 11, 2015. U.S. application Ser. No. 14/651,410 is a National Stage of PCT/JP2013/083055, which was filed on Dec. 10, 2013. This application is based upon and claims the benefit of priority to Japanese Application No. 2012-286247, which was filed on Dec. 27, 2012.

TECHNICAL FIELD

The present invention relates to a water-based coolant and, in particular, to a water-based coolant usable, for instance, for quenching a metal component.

BACKGROUND ART

Coolants (quenchants) usable for, for instance, quenching metal components are mainly categorized into an oil-based quenchant and a water-based quenchant (an aqueous solution), the oil-based quenchant being frequently used. Using the oil-based quenchant, which exhibits an appropriate cooling performance, results in a reduced quenching distortion and thus in avoidance of quenching cracks.

However, in quenching a particularly large metal component or a metal component with poor hardenability using the oil-based quenchant, the cooling speed is slow and the cooling performance is insufficient. Accordingly, the water-based quenchant is used. However, in the case of using the water-based quenchant, the cooling performance of which is higher than that of the oil-based quenchant, uneven cooling is likely to occur and thus quenching cracks may be caused.

Quenching with a saline solution has been known for a long time as a technique of improving an uneven-cooling resistance. The saline solution, which does not experience a steam film stage, exhibits a high uneven-cooling resistance as well as a high cooling performance and thus reduces quenching cracks (see Non-Patent Literature 1). However, when the saline solution is used as a quenchant, rust forms in quite a short time of one hour or less after the start of a quenching treatment, resulting in severe corrosion of equipment such as an oil bath. Accordingly, the saline solution is hardly used in an industrial application.

In view of the above, it has been suggested that a water-based quenchant containing an organic acid such as formic acid and acetic acid, an inorganic acid such as hydrochloric acid and sulfuric acid, or a salt thereof is used to improve the cooling speed (see Patent Literatures 1 and 2).

CITATION LIST

Patent Literature(s)

Patent Literature 1: JP-A-64-42521
Patent Literature 2: JP-A-1-259119

Non-Patent Literature(s)

Non-Patent Literature 1: "Yaki-ware wo kangaeru (study on quenching cracks)" edited by Shigeo OWAKU, Quenching Treatment, published in June, 1967, the seventh volume, Issue No. 3, pp. 140-144

SUMMARY OF THE INVENTION

Problems to be Solved by the Invention

However, even the water-based quenchant of Patent Literature 1 or 2 may cause the corrosion of a metal material to be cooled.

An object of the invention is to provide a water-based coolant that is excellent in cooling performance and unlikely to cause corrosion of a metal material to be cooled.

Means for Solving the Problems

In order to solve the above-mentioned problems, according to an aspect of the invention, there is provided a water-based coolant as described below.

(1) A water-based coolant contains: at least one inorganic acid salt selected from among carbonate, hydrogen carbonate, sesquicarbonate, phosphate, borate, molybdate and tungstate; and a metal corrosion inhibitor.

(2) In the water-based coolant, the metal corrosion inhibitor is at least one compound selected from among a benzotriazole compound, a benzimidazole compound, a benzothiazole compound and a benzothiadiazole compound.

(3) The water-based coolant further contains a bactericide.

(4) In the water-based coolant, a content of the bactericide is in a range from 0.001 mass % to 0.5 mass % of a total amount of the coolant.

(5) In the water-based coolant, a content of the inorganic acid salt is in a range from 1 mass % to 20 mass % of a total amount of the coolant.

(6) In the water-based coolant, a content of the metal corrosion inhibitor is in a range from 0.01 mass % to 1 mass % of a total amount of the coolant.

(7) In the water-based coolant, the inorganic acid salt is an inorganic acid metal salt.

(8) In the water-based coolant, the inorganic acid salt is at least one of a sodium salt, a potassium salt, a calcium salt and a magnesium salt.

(9) In the water-based coolant, the phosphate is at least one of orthophosphate, hydrogenphosphate, dihydrogenphosphate, polyphosphate and metaphosphate.

(10) In the water-based coolant, the water-based coolant is used as a quenching oil or a cutting oil.

The above aspect of the invention can provide a water-based coolant that is excellent in cooling performance and unlikely to cause corrosion of a metal material to be cooled.

DESCRIPTION OF EMBODIMENT(S)

According to an exemplary embodiment, a water-based coolant (hereinafter occasionally simply referred to as "the present coolant") is provided by blending a specific inorganic acid salt and a metal corrosion inhibitor. The present coolant will be described below in details.

Examples of the inorganic acid salt in the present coolant include carbonate, hydrogen carbonate, sesquicarbonate, phosphate, hydrosulfate, borate, molybdate and tungstate. The above salts may be used alone or mixed in use.

Among the above inorganic acid salts, carbonate, hydrogen carbonate, sesquicarbonate and phosphate are preferable in terms of cooling effect. Carbonate and hydrogen carbonate are preferably mixed in use for the purpose of pH control.

Phosphate may be any one of orthophosphate, hydrogenphosphate, dihydrogenphosphate, polyphosphate and metaphosphate. Examples of polyphosphate include diphosphate (pyrophosphate) and tripolyphosphate. Among the above, pyrophosphate is preferable in terms of cooling effect. The above phosphates may be used alone or mixed in use. The above phosphates may be mixed with the inorganic salt.

The inorganic acid salt is preferably a metal salt, specific examples of which include sodium salt, potassium salt, calcium salt and magnesium salt. Among the above, sodium salt and potassium salt are preferable in terms of cooling performance.

The present coolant preferably has a pH of 7 or higher in terms of corrosion resistance.

The content of the inorganic acid salt in the present coolant is preferably in a range from 1 mass % to 20 mass % of the total amount of the present coolant and more preferably in a range from 3 mass % to 15 mass %. When the content of the inorganic acid salt is less than 1 mass %, the cooling effect may be insufficient. In contrast, even when the content of the inorganic acid salt exceeds 20 mass %, a significant improvement in the cooling effect is not promising.

The present coolant contains the metal corrosion inhibitor. Preferable examples of the metal corrosion inhibitor include a benzotriazole compound, a benzimidazole compound, a benzothiazole compound and a benzothiadiazole compound. The above compounds may be used alone or mixed in use.

It should be noted that the benzotriazole compound includes benzotriazole and derivatives thereof. The same applies to the benzimidazole compound, the benzothiazole compound and the benzothiadiazole compound.

Examples of the benzotriazole compound include: alkylbenzotriazole in which a benzene ring is substituted with an alkyl group; and (alkyl)aminoalkyl benzotriazole in which hydrogen of an amino group is substituted with an alkyl group.

The content of the metal corrosion inhibitor is preferably in a range from 0.01 mass % to 1 mass % of the total amount of the present coolant and more preferably in a range from 0.1 mass % to 0.7 mass %. When the content of the metal corrosion inhibitor is less than 0.01 mass %, the metal corrosion resistance effect may be insufficient. In contrast, even when the content of the metal corrosion inhibitor exceeds 1 mass %, a significant improvement in the metal corrosion resistance effect is not promising.

The present coolant may further contain a bactericide as needed. Examples of the bactericide include a benzisothiazoline compound, an isothiazoline compound, a triazine compound and a pyrithione compound. The benzisothiazoline compound includes benzisothiazoline and derivatives thereof. The same applies to the isothiazoline compound, the triazine compound and the pyrithione compound.

Specific examples of the benzisothiazoline compound include benzisothiazoline, 1,2-benzisothiazoline-3-one, 2-methyl isothiazoline-3-one and 5-chloro-2-methyl-4-isothiazoline-3-one. Examples of the triazine compound include hexahydro-1,3,5-tris-(2-hydroxyethyl)triazine. Examples of the pyrithione compound include sodium pyrithione.

The content of the bactericide is preferably in a range from 0.001 mass % to 0.5 mass % of the total amount of the present coolant and more preferably in a range from 0.01 mass % to 0.4 mass %. When the content of the bactericide is less than 0.001 mass %, a sufficient antibacterial effect may not be obtained. In contrast, even when the content of the bactericide exceeds 0.5 mass %, a significant improvement in the antibacterial effect is not promising.

The present coolant may further contain a water-soluble rust inhibitor as needed. In view of improvement in rust resistance and economical balance, the content of the water-soluble rust inhibitor is preferably in a range from 0.01 mass % to 5 mass % of the total amount of the present coolant and more preferably in a range from 0.03 mass % to 1 mass %. Examples of the water-soluble rust inhibitor include aliphatic monocarboxylates such as octanate, and aliphatic dicarboxylates such as octanedioic acid (suberate) salt and decanedioic acid (sebacate) salt, among which potassium sebacate or the like is preferably usable. Aromatic carboxylates may be used as the water-soluble rust inhibitor. A piperazine derivative such as monohydroxy monoethyl piperazine may also be favorably used as the water-soluble rust inhibitor.

The present coolant may further contain typical additives such as an antioxidant and a detergent dispersant.

The present water-based coolant, which does not experience a steam film stage, exhibits a high cooling performance. Further, the present water-based coolant is unlikely to cause corrosion of a metal material to be cooled, and thus is suitably usable as a quenching oil or a cutting oil for metal materials.

EXAMPLES

Now, the invention will be further described in detail with reference to Examples and Comparatives, which by no means limit the invention.

Examples 1 to 16 and Comparatives 1 to 5

Preparation of Sample Solutions

Sample solutions were prepared by blending an ion-exchange water with the following additives. It should be noted that Table 1 additionally indicates the pH of each of the sample solutions. A sample of Reference Example consisted solely of an ion-exchange water without addition of any additive.

Inorganic Acid Salt, etc. (see Table 1): 10 mass % of the sample solution

Metal Corrosion Inhibitor (benzotriazole): 0.5 mass % of the sample solution

Bactericide:

Examples 1 to 3 and 9 to 16 and Comparatives 1 to 5: benzisothiazoline (active ingredient amount: 7 mass %) in an amount of 0.05 mass % of the sample solution (concentration in the sample solution: 0.0035 mass %)

Example 4: benzisothiazoline in an amount of 0.15 mass % of the sample solution (concentration in the sample solution: 0.0108 mass %)

Example 5: hexahydro-1,3,5-tris-(2-hydroxyethyl)triazine in an amount of 0.1 mass % of the sample solution (concentration in the sample solution: 0.080 mass %)

Example 6: 5-chloro-2-methyl-4-isothiazoline-3-one in an amount of 0.3 mass % of the sample solution (concentration in the sample solution: 0.0060 mass %)

Example 7: 5-chloro-2-methyl-4-isothiazoline-3-one in an amount of 0.05 mass % of the sample solution (concentration in the sample solution: 0.0010 mass %)

Example 8: sodium pyrithione in an amount of 0.05 mass % of the sample solution (concentration in the sample solution: 0.020 mass %)

It should be noted that the sample solution of Example 15 and the sample solution of Example 16 further contained sodium hydrogen carbonate in an amount of 1.0 mass % and 3.0 mass %, respectively, and the sample of Reference Example consisted solely of an ion-exchange water without addition of any additive.

Cooling Test

The sample solutions kept at 50 degrees C. were each subjected to a cooling test according to JIS K2242B to measure characteristic seconds. Specifically, time (seconds) elapsed before a temperature where a steam film stage came to an end (i.e., a characteristic temperature) was reached according to a cooling curve was measured. The results are shown in Table 1.

Metal Corrosion Test

A metal material (S45C) was half-immersed at 30 degrees C. for three days, and then evaluated in terms of the degree of corrosion based on the following standards. The results are shown in Table 1.

A: neither rust nor discoloration

A: either rust or discoloration

Corruption Test 5.5 mL of bacteria (the number of bacteria such as *Escherichia coli* and *Bacillus subtilis:* $10^8$) added to each of the sample solutions (100 mL) were subjected to static culture at 30 degrees C. for one week, and then the number of bacteria was counted. The results are shown in Table 1.

TABLE 1

| | Additive (Inorganic Acid Salt, etc.) | pH | Characteristic Seconds (50° C.) | Anti-corrosive Properties | Anti-corruption Properties (Number of Bacteria) |
|---|---|---|---|---|---|
| Ex. 1 | Sodium Tripolyphosphate | 7.80 | 0.21 | A | 0 |
| Ex. 2 | Disodium Hydrogenphosphate | 8.30 | 0.15 | A | 0 |
| Ex. 3 | Potassium Pyrophosphate | 9.25 | 0.1 or less | A | 0 |
| Ex. 4 | Potassium Pyrophosphate | 9.10 | 0.1 or less | A | 0 |
| Ex. 5 | Potassium Pyrophosphate | 9.07 | 0.1 or less | A | 0 |
| Ex. 6 | Potassium Pyrophosphate | 9.07 | 0.1 or less | A | 0 |
| Ex. 7 | Potassium Pyrophosphate | 9.08 | 0.1 or less | A | 0 |
| Ex. 8 | Potassium Pyrophosphate | 9.06 | 0.1 or less | A | 0 |
| Ex. 9 | Sodium Metaphosphate | 6.30 | 0.51 | A | 0 |
| Ex. 10 | Sodium Borate | 10.80 | 0.31 | A | 0 |
| Ex. 11 | Sodium Molybdate | 6.90 | 0.24 | A | 0 |
| Ex. 12 | Sodium Tungstate | 8.00 | 1.27 | A | 0 |
| Ex. 13 | Sodium Carbonate | 10.20 | 0.1 or less | A | 0 |
| Ex. 14 | Potassium Carbonate | 11.10 | 0.1 or less | A | 0 |
| Ex. 15 | Sodium Carbonate + Sodium Hydrogen Carbonate (1 mass %) | 9.60 | 0.80 | A | 0 |
| Ex. 16 | Sodium Carbonate + Sodium Hydrogen Carbonate (3 mass %) | 9.10 | 1.20 | A | 0 |
| Comp. 1 | Sodium Sulfate | 6.20 | 0.20 | B | 0 |
| Comp. 2 | Sodium Formate | 6.60 | 1.58 | B | $10^3$ |
| Comp. 3 | Potassium Formate | 7.60 | 1.17 | B | 0 |
| Comp. 4 | Sodium Nitrate | 6.00 | 1.27 | B | 0 |
| Comp. 5 | Sodium Chloride | 6.10 | 0.1 or less | B | $10^3$ |
| Ref. | (Ion-exchange Water) | 5.78 | 6.16 | B | $10^7$ |

Evaluation Results

As is evident from the results in Table 1, it has been found that the water-based coolants according to the invention, each of which is a solution prepared with a specific inorganic acid salt, achieve significantly short characteristic seconds and exhibit a considerably high cooling performance. Further, the water-based coolants according to the invention are each unlikely to cause corrosion of a metal material with the assistance of the metal corrosion inhibitor added thereto. Therefore, it can be understood that the water-based coolants according to the invention are considerably effective in quenching or cutting a metal material.

The water-based coolants according to the invention each exhibit an excellent antibacterial effect with the assistance of the bactericide added thereto, whereas the water-based coolants according to Comparatives sometimes fail to exhibit an antibacterial effect even when the same bactericide is added thereto.

Generally, when a water temperature rises to 30 degrees C. or higher, the cooling performance of water is sharply decreased to be insufficient for quenching. In view of the above, it is notable that the water-based coolants according to the invention each exhibit an excellent cooling performance even when the fluid temperature reaches 50 degrees C.

It should be noted that the ion-exchange water of Reference Example, which is devoid of the specific inorganic acid salt according to the invention, is insufficient in cooling performance. Addition of an inorganic acid salt different from the inorganic acid salt according to the invention or an organic acid salt does not lead to improvement in cooling performance.

INDUSTRIAL APPLICABILITY

The coolant according to the invention, which is excellent in cooling performance and unlikely to cause corrosion of a metal material to be cooled, is usable as a quenchant (quenching oil) or a cutting oil for metal materials.

The invention claimed is:

1. A method, comprising quenching or cutting a metal material using a water-based coolant consisting of:

water;

at least one inorganic acid salt selected from the group consisting of a carbonate, a hydrogen carbonate, a sesquicarbonate, a phosphate, a borate, a molybdate and a tungstate;

at least one metal corrosion inhibitor selected from the group consisting of a benzotriazole compound, a benzimidazole compound, a benzothiazole compound and a benzothiadiazole compound; and optionally at least one of a bactericide and an antioxidant.

2. The method according to claim 1, wherein the metal corrosion inhibitor is at least one selected from the group consisting of a benzotriazole compound, a benzimidazole compound, and a benzothiazole compound.

3. The method according to claim 1, wherein the water-based coolant contains a bactericide.

4. The method according to claim 3, wherein a content of the bactericide in the water-based coolant is in a range from 0.001 mass % to 0.5 mass % of a total amount of the coolant.

5. The method according to claim 1, wherein a content of the inorganic acid salt in the water-based coolant is in a range from 1 mass % to 20 mass % of a total amount of the coolant.

6. The method according to claim 1, wherein a content of the metal corrosion inhibitor in the water-based coolant is in a range from 0.01 mass % to 1 mass % of a total amount of the coolant.

7. The method according to claim 1, wherein the water-based coolant includes an inorganic acid metal salt as the inorganic acid salt.

8. The method according to claim 7, wherein the inorganic acid salt is at least one of a sodium salt, a potassium salt, a calcium salt and a magnesium salt.

9. The method according to claim 1, wherein the water-based coolant includes at least one of an orthophosphate, a hydrogenphosphate, a dihydrogenphosphate, a polyphosphate and a metaphosphate as the phosphate.

10. The method according to claim 1, wherein the water-based coolant consists of:

the water;

the at least one inorganic acid salt;

the metal corrosion inhibitor; and a bactericide and an antioxidant.

11. The method according to claim 1, wherein the metal corrosion inhibitor is a benzotriazole compound.

* * * * *